US011097812B2

(12) United States Patent
Lee

(10) Patent No.: US 11,097,812 B2
(45) Date of Patent: Aug. 24, 2021

(54) ELECTRIC SURFBOARD

(71) Applicant: JETWAKE Co., Ltd, Busan (KR)

(72) Inventor: Kuk Jin Lee, Seoul (KR)

(73) Assignee: JETWAKE CO., LTD, Busan (KR)

( * ) Notice: Subject to any disclaimer, the term of this patent is extended or adjusted under 35 U.S.C. 154(b) by 16 days.

(21) Appl. No.: 16/682,690

(22) Filed: Nov. 13, 2019

(65) Prior Publication Data

US 2021/0139114 A1 May 13, 2021

(51) Int. Cl.

| | |
|---|---|
| ***B63B 32/10*** | (2020.01) |
| ***B63H 11/02*** | (2006.01) |
| ***B63B 32/40*** | (2020.01) |
| *B63B 32/73* | (2020.01) |

(52) U.S. Cl.

CPC ..... *B63B 32/10* (2020.02); *B63B 32/45* (2020.02); *B63H 11/02* (2013.01); *B63B 32/73* (2020.02)

(58) Field of Classification Search

CPC ..... B63B 32/45; B63B 32/10; B63B 32/73; B63H 11/02

See application file for complete search history.

(56) References Cited

U.S. PATENT DOCUMENTS

| | | | | |
|---|---|---|---|---|
| 2010/0025967 | A1* | 2/2010 | Flaig | A63C 10/10 280/612 |
| 2010/0059969 | A1 | 3/2010 | Scharman et al. | |
| 2017/0267319 | A1 | 9/2017 | Morash et al. | |
| 2018/0346119 | A1* | 12/2018 | Henry | B64C 39/026 |
| 2019/0308696 | A1* | 10/2019 | Tian | B63B 32/00 |
| 2020/0231264 | A1* | 7/2020 | Imai | B63B 32/60 |

FOREIGN PATENT DOCUMENTS

| | | | | |
|---|---|---|---|---|
| JP | 09-76990 | A | 3/1997 | |
| JP | 10-314365 | A | 12/1998 | |
| KR | 10-2016-0057060 | A | 5/2016 | |
| KR | 10-2017-0046886 | A | 5/2017 | |
| KR | 10-1758290 | B1 | 5/2017 | |
| KR | 10-1753612 | B1 | 7/2017 | |
| KR | 10-1819497 | B1 | 1/2018 | |
| KR | 10-2018-0027456 | A | 3/2018 | |
| WO | WO-2019143276 | A1 * | 7/2019 | B63H 11/08 |

* cited by examiner

*Primary Examiner* — Stephen P Avila

(74) *Attorney, Agent, or Firm* — Novick, Kim & Lee, PLLC; Jae Youn Kim

(57) ABSTRACT

Disclosed is an electric surfboard that can determine whether or not a user is on board while the surfboard is working, and if not, can stop operation of the surfboard, and that can naturally cool heat generated from a control unit and a motor unit. The electric surfboard includes a surfboard housing, foot bindings which are put on a user, a step-out detecting unit for creating a magnetic field and attracted to the housing by a magnetic force, as well as being physically coupled to an ankle strap, in which if the user steps out of the surfboard, the step-out detecting unit being detached from the housing, thereby detecting step-out of the user, and a control unit receiving a step-out detecting signal outputted from the step-out detecting unit to send a signal for stopping operation of the surfboard.

1 Claim, 13 Drawing Sheets

ELECTRIC SURFBOARD

BACKGROUND OF THE INVENTION

Field of the Invention

The present invention relates to an electric surfboard, and more particularly, to an electric surfboard, in which a control unit determines whether or not a user is on board while the surfboard is working, and if not, the control unit stops operation of the surfboard, and in which a structure for naturally cooling the control unit and a motor unit, which generate a lot of heat, among components of the surfboard is improved.

Background of the Related Art

Electric motorized surfboards have a problem in that in the case where a user loses balance and falls into water while standing on the surfboard, a motor does not stop working, and the working continues. One of methods for solving the above problem is disclosed by Korean Patent No. 10-1758290, in which the speed of a motor is controlled by a handle. There are some instances where an electric surfboard is not provided with a handle for controlling the surfboard, if necessary. Accordingly, there is needed an improved electric surfboard capable of detecting the case where a user steps out of the surfboard, and stopping operation of a motor, by taking all the circumstances into consideration.

Also, in the case of the electric motorized surfboards, a control unit and a motor unit for operating the surfboard generate a lot of heat. A method for cooling the heat generated from the control unit and the motor unit is disclosed by Korean Patent No. 10-1758290, in which the motor is cooled by a cooling water. In order to cool the motor unit by circulating the cooling water, additional components are required, and thus the configuration is complicated, which increases a maintenance fee.

PATENT LITERATURES

Patent Document 1: Korean Patent Publication No.: 10-1753612, entitled "Attaching/detaching device for snowboard binding"

Patent Document 2: Korean Patent Publication No.: 10-1819497, entitled "Driving device for skateboard with detachable foot hanger controlled by portable smart device"

Patent Document 3: Korean Patent Publication No.: 10-1758290, entitled "Modular surfboard driven by waterjet"

Patent Document 4: Japanese Laid-Open Patent Publication No.: H09-76990, entitled "Leash of surfboard or the like"

Patent Document 5: Japanese Laid-Open Patent Publication No.: H10-314365, entitled "Magnetic device for snowboard"

Patent Document 6: US Patent Application Publication No.: 2010/0059969, entitled "Magnetic easy step in/out snowboard binding"

SUMMARY OF THE INVENTION

Therefore, the present invention has been made in view of the above problems, and an object of the present invention is to provide an electric surfboard that can determine whether or not a user is on board while the surfboard is working, and if not, can stop operation of the surfboard, and that can naturally cool heat generated from a control unit and a motor unit.

The present invention is not limited to the above-described object, and other objects can be clearly understood by those skilled in the art from the description below.

In order to achieve the above object, according to one aspect of the present invention, there is provided an electric surfboard including: a surfboard housing; foot bindings which are disposed on a top surface of the surfboard housing at front and rear portions thereof, respectively; a battery pack unit which is detachably mounted in a space between the foot bindings from the top surface of the surfboard housing to a bottom surface; a control room unit which is fixed to the bottom surface of the surfboard housing in a space between a bottom surface of the battery pack unit and the bottom surface of the surfboard housing so as to be naturally cooled by water flowing below a rear surface of the surfboard when a motor operates, the control room unit controlling operation of the motor; a motor unit which is driven under a control of the control room unit, is fixed to one side of the control room unit, and is disposed on the bottom surface of the surfboard housing so as to be naturally cooled by the water flowing below the rear surface of the surfboard when a motor operates; and a waterjet unit which is coupled to the motor unit in series to generate a driving force of the surfboard according to operation of the motor unit, in which the battery pack unit is disposed at a center region of the surfboard, which corresponds to a center of gravity, in view of series arrangement of the motor unit and the waterjet unit.

Also, a pair of connectors are respectively disposed on the bottom surface of the battery pack unit and a top surface of the control room unit to be connected to the battery pack unit and the control room unit, thereby supplying a power from the battery pack unit to the control room unit.

The top surface of the control room unit is provided with a first partition protruding upwardly from one end thereof, a second partition protruding upwardly and disposed inside the first partition, a waterproof groove formed in a space between the first and second partitions, and a connector receiving groove formed inside the second partition to receive the control room connector.

A bottom surface of the battery pack unit is provided with a seating groove, a base formed in the seating groove, a protrusion protruding from the base and formed in a shape corresponding to the first and second partitions, and a waterproof sealing fitted onto the protrusion in a circumferential direction and inserted in the waterproof groove together with the protrusion.

The control room connector has first and second guides which are spaced apart from each other at a certain interval and protrude upwardly, power connecting terminal formed between the first and second guides, and a control terminal which is formed between the first and second guides to transmit a control signal outputted from the control room unit.

The battery connector is provided with first and second guide grooves for receiving the first and second guides, a power connecting terminal receiving groove for receiving the power connecting terminal and to be electrically connected to the power connecting terminal, and a control terminal receiving groove for receiving the control connecting terminal and to be electrically connected to the control connecting terminal.

Also, in order to achieve the above object, according to another aspect of the present invention, there is provided an electric surfboard including a surfboard housing, foot bindings which are put on a user, a step-out detecting unit for creating a magnetic field and attracted to the housing by a magnetic force, as well as being physically coupled to an ankle strap, in which if the user steps out of the surfboard, the step-out detecting unit being detached from the housing, thereby detecting step-out of the user, and a control unit receiving a step-out detecting signal outputted from the step-out detecting unit to send a signal for stopping operation of the surfboard.

The step-out detecting unit includes attaching member having a magnet, a holder fixed to the top surface of the surfboard, in which the attaching member is seated on a top surface of the holder by the magnetic force, a metal member seated on a bottom surface of the holder and cooperating with the magnet to secure the attaching member, and a sensor unit disposed on the bottom surface of the holder to detect the magnetic field to send a step-out detecting signal if the user steps out of the surfboard and thus the attaching member is detached from the holder.

Also, the electric surfboard includes a detachable battery pack unit mounted on the surfboard housing from the top surface to the bottom surface, and an air circulating member fixed to the holder to communicate with the inner space of the battery pack unit, thereby discharging the heat generated from the battery pack unit to the outside and circulate the air.

The air circulating member has a head portion with a fabric portion for air circulation, a shank portion extending from the head portion and threadedly fastened to the holder, a guide formed on a bottom surface of the head portion, and a waterproof ring provided on an outer peripheral surface of the guide to prevent intrusion of water when the air circulating member is fixed to the holder.

With the above configuration of the present invention, the control unit determines whether or not the user is on board while the surfboard is working, and if not, the control unit stops operation of the surfboard. Also, it is possible to naturally cool the heat generated from the control unit and a motor unit.

DETAILED DESCRIPTION OF THE PREFERRED EMBODIMENT

Hereinafter, preferred embodiments of the present invention will be explained in detail with reference to the accompanying drawings so that those skilled in the art can easily carry out the present invention. In the following description, detailed descriptions of well-known functions or constructions will be omitted since they would obscure the invention in unnecessary detail.

Embodiment 1

Figure 1:
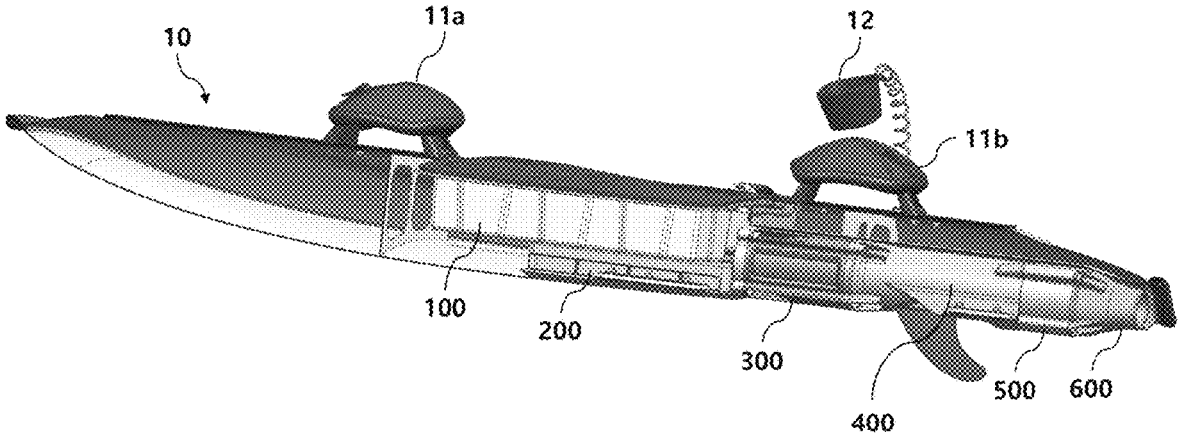
FIG. 1 is a perspective view illustrating an electric surfboard according to the first embodiment of the present invention.

An electric surfboard according to the first embodiment of the present invention includes a surfboard housing 10, a control room unit and a motor unit which are disposed on a bottom surface of the surfboard housing 10 so as to be cooled by water flowing below a rear surface of the surfboard, and a connector coupling structure for connecting the control room unit and a battery pack unit. The surfboard includes, as illustrated in FIG. 1, foot bindings 11*a* and 11*b* disposed on a top surface of the surfboard housing 10 at front and rear portions thereof, respectively. A user of the surfboard can drive the surfboard in a wanted direction by inserting and holding user's feet into the foot bindings 11*a* and 11*b*. The foot bindings 11*a* and 11*b* are provided on the top surface of the surfboard housing at the front and rear portions thereof in a diagonal line or straight line, respectively. The electric surfboard of the first embodiment includes an ankle strap 12 extending from the surfboard housing 10 at a position adjacent to the rear foot binding 11*b* so that the user wears the ankle strap 12 on a user's angle. Since the electric surfboard according to the present invention is driven by a power, if the user steps out of the surfboard while the user is riding on the surfboard, the ankle strap 12 which is in cooperation with a magnetic sensor is separated from the magnetic sensor, so that the supply of the power to the motor is interrupted to automatically stop operation of the electric surfboard.

Figure 2:
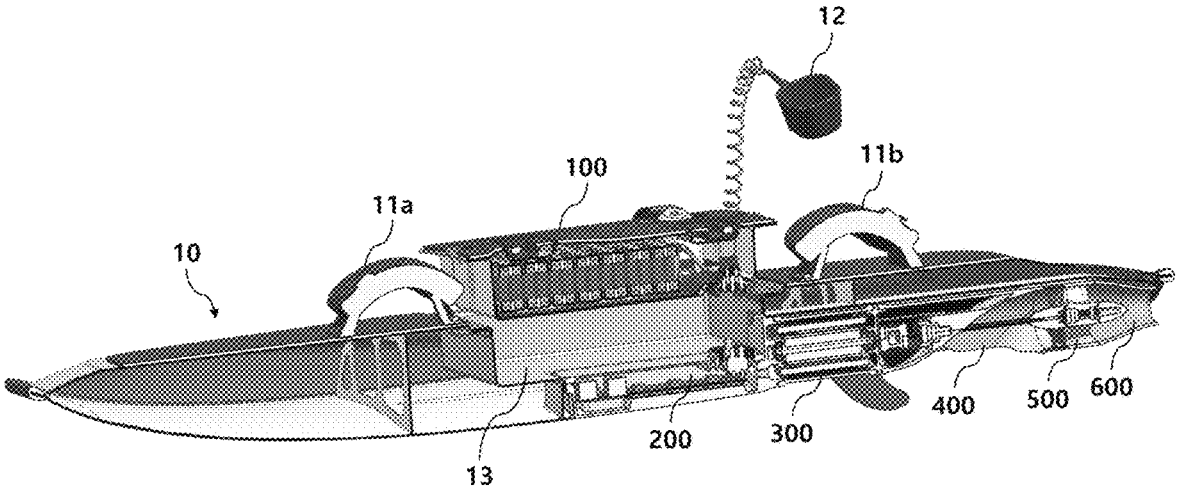
FIG. 2 is a cross-sectional view illustrating the electric surfboard according to the first embodiment of the present invention.

As illustrated in FIG. 2, the electric surfboard of the first embodiment further includes a battery pack unit 100 easily detachably mounted in a battery receiving groove 13 which is formed on the top surface of the surfboard housing 10. The battery pack unit 100 is disposed in a space between the foot bindings 11*a* and 11*b* which is an approximately center region of the surfboard housing 10 to balance the electric surfboard. A bottom surface of the battery pack unit 100 and a bottom surface of the battery receiving groove 13 are provided with a space to receive a control room unit 200 which will be described below. The battery pack unit 100 has a plurality of battery cells 110 which are packed to supply the power to the electric surfboard. As illustrated in FIG. 2, when the battery pack unit 100 is inserted in the battery receiving groove 13, the battery pack unit 100 should be electrically connected with the control room unit 200 via a connector to supply the power to the control room unit 200 and receive data outputted from the control room unit. A method for coupling the battery pack unit 100 and the control room unit 200 will now be described.

Figure 3:
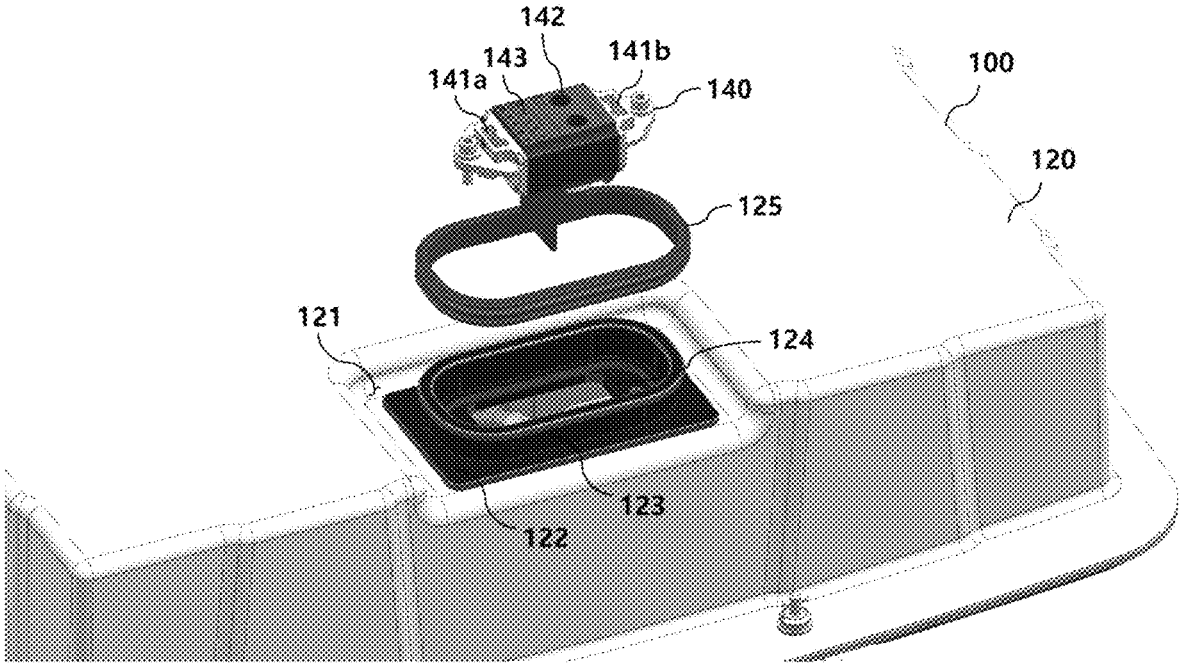
FIGS. 3 and 4 are perspective views illustrating a battery connector coupling member according to the first embodiment.
Figure 8:
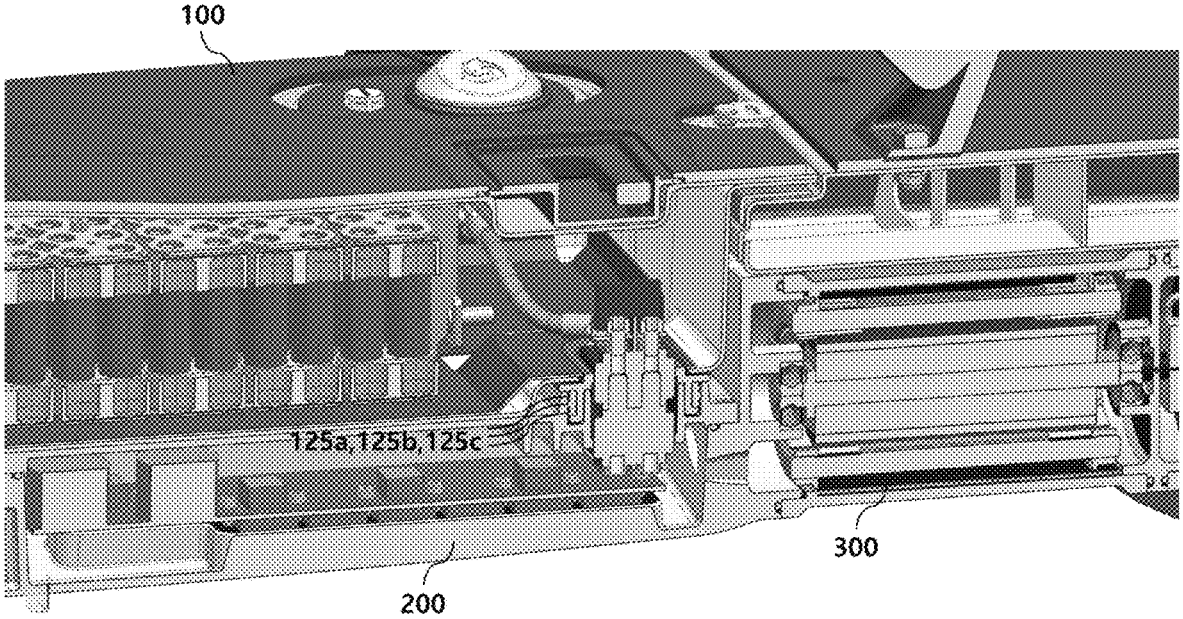

As illustrated in FIG. 3, a bottom surface 120 of the battery pack unit 100 is provided with a battery connector coupling member at a center region of one end of the bottom surface 120. The battery connector coupling member generally has a seating groove 121, a base 122, a protrusion 123, a connector receiving groove 124, a waterproof sealing 125 and a battery connector 140. The seating groove 121 is formed to have a depth in such a way that the protrusion 123 is inserted into the waterproof groove 215, as illustrated in FIG. 8. The seating groove 121 is formed in such a way that the base 122 and the protrusion 123 upwardly protruding from the base 122 have a certain thickness. The protrusion 123 is provided on an inside thereof with a connector receiving groove 124 to receive the battery connector 140. The protrusion 123 is formed in the shape of a circle or ellipse, and the waterproof sealing 125 is attached to an outer peripheral portion of the protrusion to prevent intrusion of water. The watertight sealing 125 is interference-fitted onto the outer peripheral portion of the protrusion 123, and also is seated on the top surface of the base 122. The waterproof sealing 125 has first, second and third sealing flanges 125*a*, 125*b* and 125*c* radially protruding from the outer peripheral surface, as illustrated in FIG. 8. The first, second and third sealing flanges 125*a*, 125*b* and 125*c* are spaced apart from each other at a certain interval in a vertical direction. The first, second and third sealing flanges 125*a*, 125*b* and 125*c* come into close contact with the inner peripheral surface of a first partition 212 when the sealing flanges are inserted into the waterproof groove 215, thereby preventing the water from permeating the inside. Preferably, the second sealing flange 125*b* formed between the first and third sealing flanges 125*a* and 125*c* has the highest vertically protruding height. Since the first, second and third sealing flanges 125*a*, 125*b* and 125*c* protrude perpendicularly from the outer peripheral surface of the waterproof sealing 125 at a certain interval, it is possible to easily attach or detach the waterproof sealing, as well as achieving a waterproof function.

Figure 4:
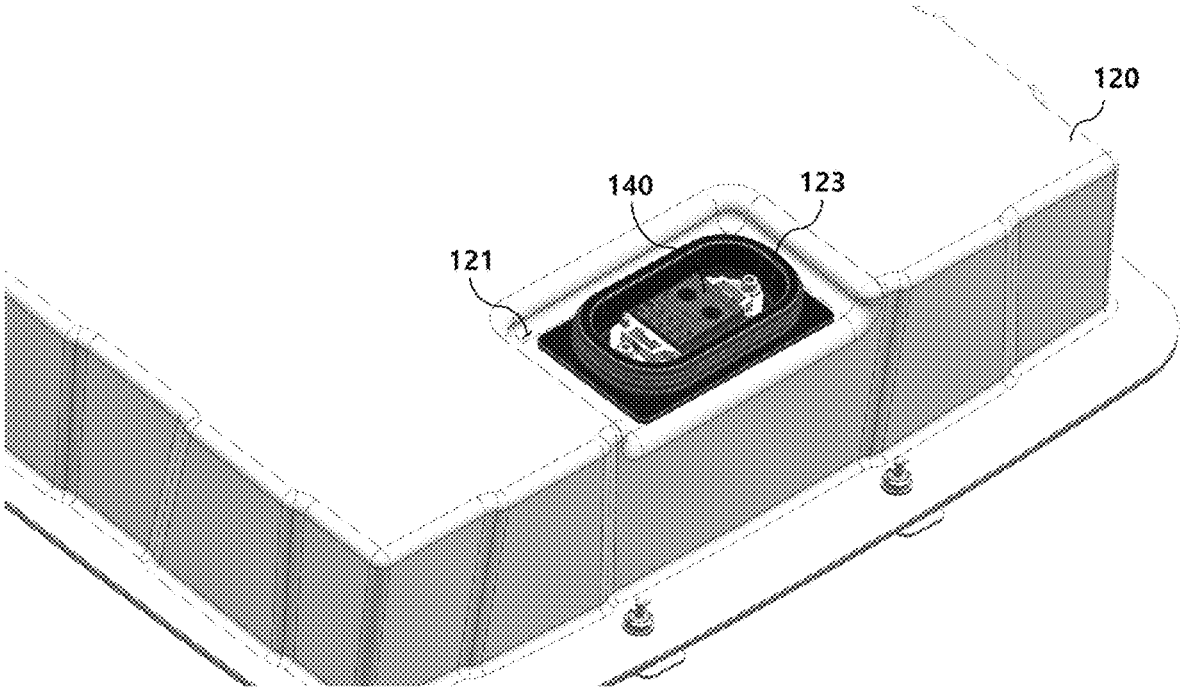

As illustrated in FIG. 4, the battery connector 140 is inserted and mounted in the connector receiving groove 124. As illustrated in FIG. 3, the battery connector 140 is provided on both sides thereof with first and second guide grooves 141*a* and 141*b*, and a power connecting terminal receiving groove 142 and a control terminal receiving groove 143 are formed in the space between the first and second guide grooves 141*a* and 141*b*.

Figure 10:
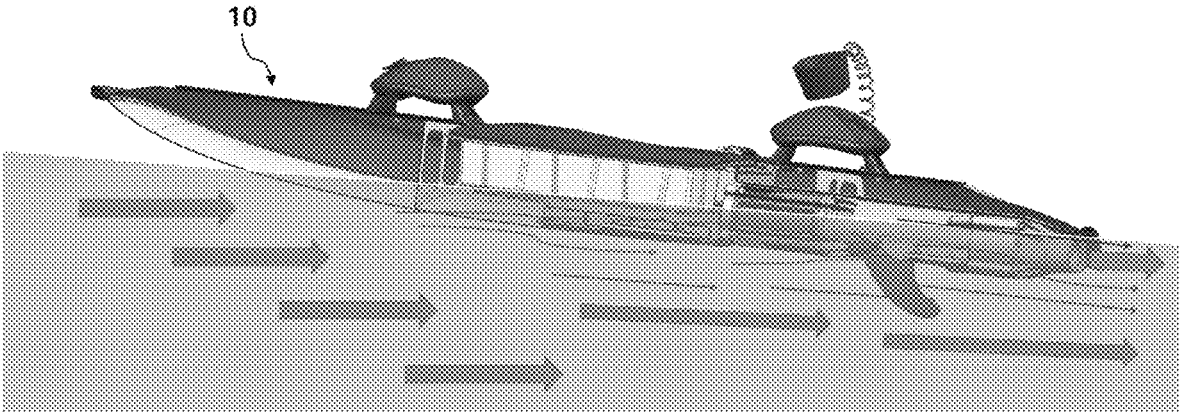
FIG. 10 is a view illustrating the electric surfboard according to the first embodiment of the present invention which is riding on a water surface.

The control room unit 200 according to the first embodiment of the present invention is disposed in the space between the battery pack 100 and the bottom surface of the surfboard housing 10, as illustrated in FIGS. 1 and 2. Accordingly, the control room unit 200 is disposed just beneath the battery pack unit 100. If the battery pack unit 100 is disposed and engaged to the bottom surface of the surfboard housing 10, as illustrated in FIG. 10, the battery pack unit 100 can be naturally cooled by the water. The control room unit 200 is configured to control operation of the motor. For example, the control room unit 200 controls the operation of the motor so that the electric surfboard moves forward with a certain output under the control of the user, and if the user steps out of the electric surfboard, the control room unit detects the step-out of the user to stop the operation of the electric surfboard.

Figure 5:
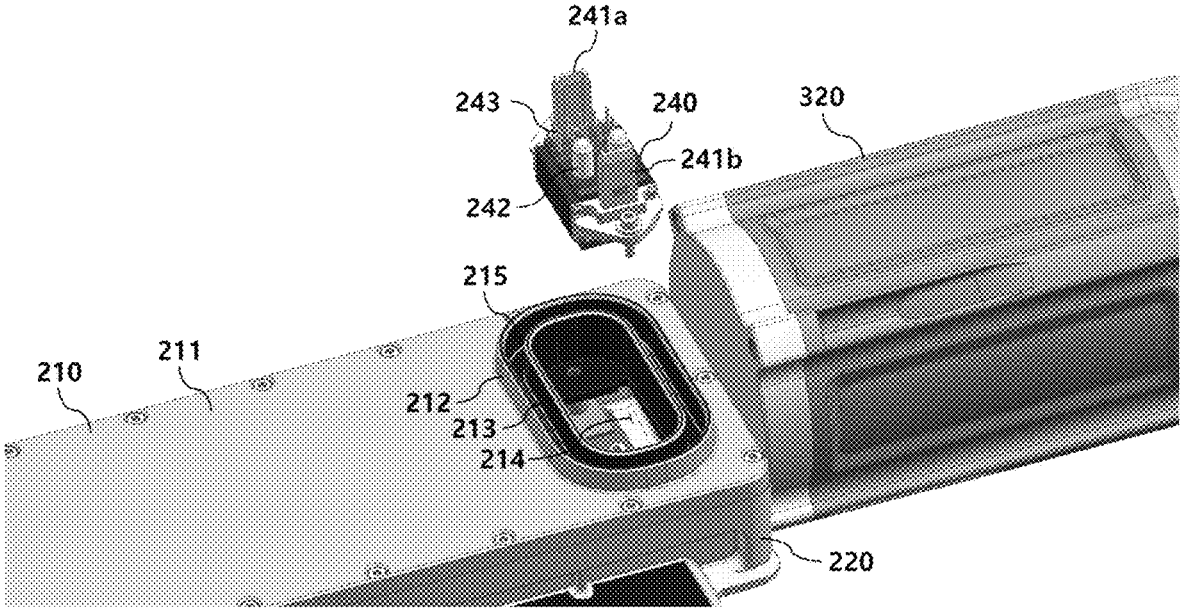
FIGS. 5 and 6 are perspective views illustrating a control room connector coupling member according to the first embodiment.
Figure 6:
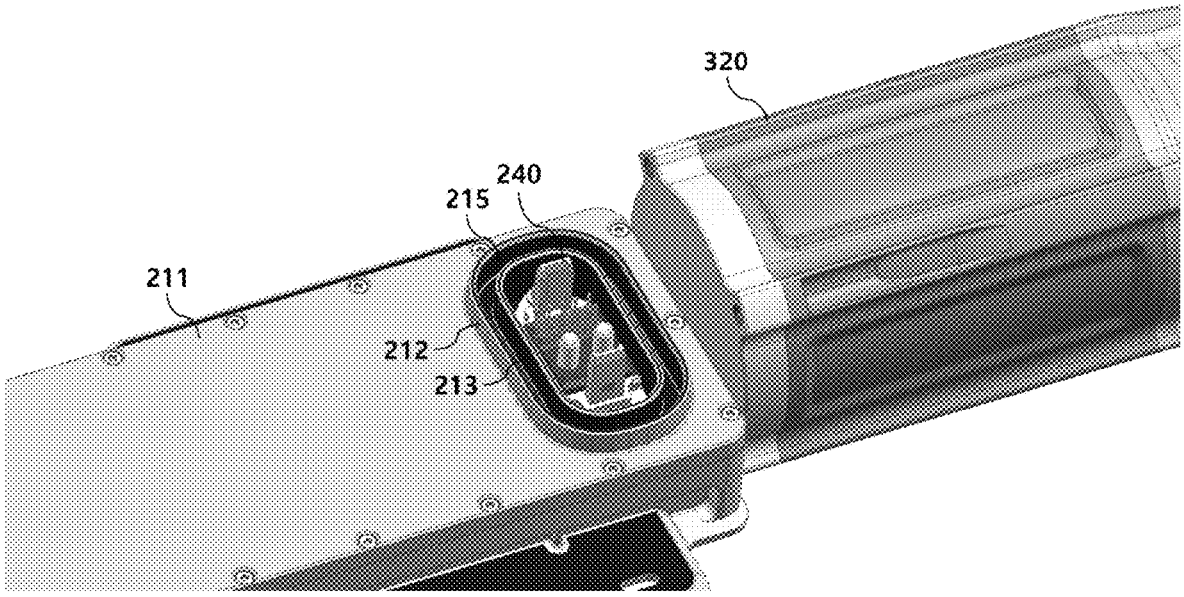
Figure 9:
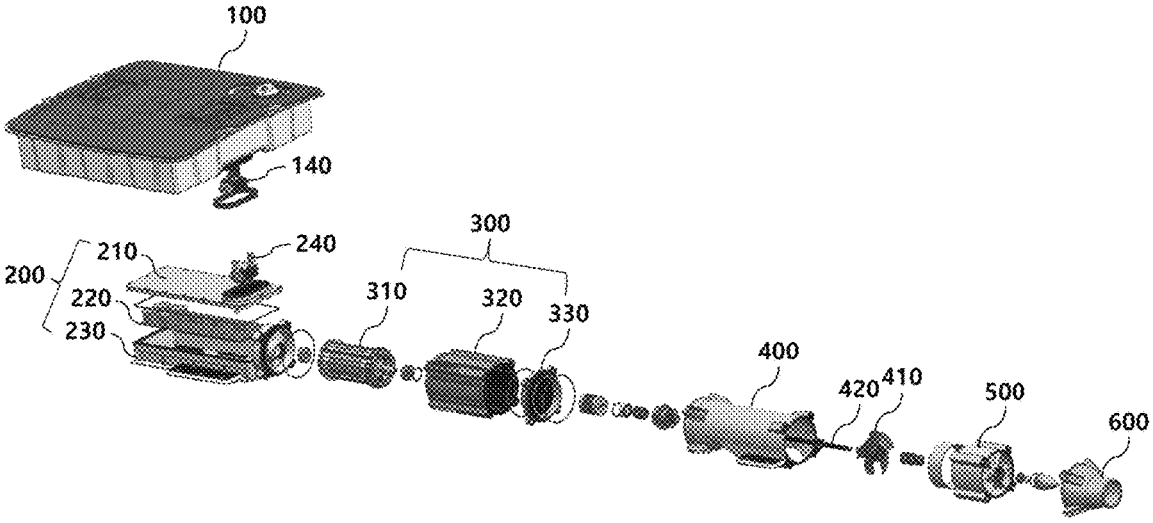
FIG. 9 is an exploded perspective view illustrating electric surfboard according to the first embodiment of the present invention.

As illustrated in FIG. 2, when the battery pack unit 100 is inserted and mounted in the defined battery receiving groove 13, the battery pack unit is electrically connected to the control room unit 200 to transmit the data and supply the power. As illustrated in FIGS. 5 and 9, the control room unit 200 has a control room cover 210, a control circuit 220, and a room housing 230. The control circuit 220 is inserted and fixed to the room housing 230. A top surface 211 of the control room cover 210 is provided on one end thereof with first and second partitions 212 and 213 which are coupling portions for the control room connector, a connector receiving groove 214, a waterproof groove 215 and a control room connector 240. The control room connector coupling member is formed at a position just beneath the battery connector coupling member. The first and second partitions 212 and 213 are spaced apart from each other at a certain interval, and protrude upwardly to form the waterproof groove 215. The first and second partitions 212 and 213 are preferably formed in the same shape as that of the protrusion 123 and the waterproof sealing 125. When the battery pack unit 100 is electrically connected to the control room unit 200, the protrusion 123 and the waterproof sealing 125 are fitted into the waterproof groove 215 to prevent intrusion of the water. The first partition 212 has a diameter larger than that of the second partition 213. The second partition 213 is provided with the connector receiving groove 214 at the inside, and the control room connector 240 is inserted and fixed to the connector receiving groove, as illustrated in FIG. 6.

Figure 7:
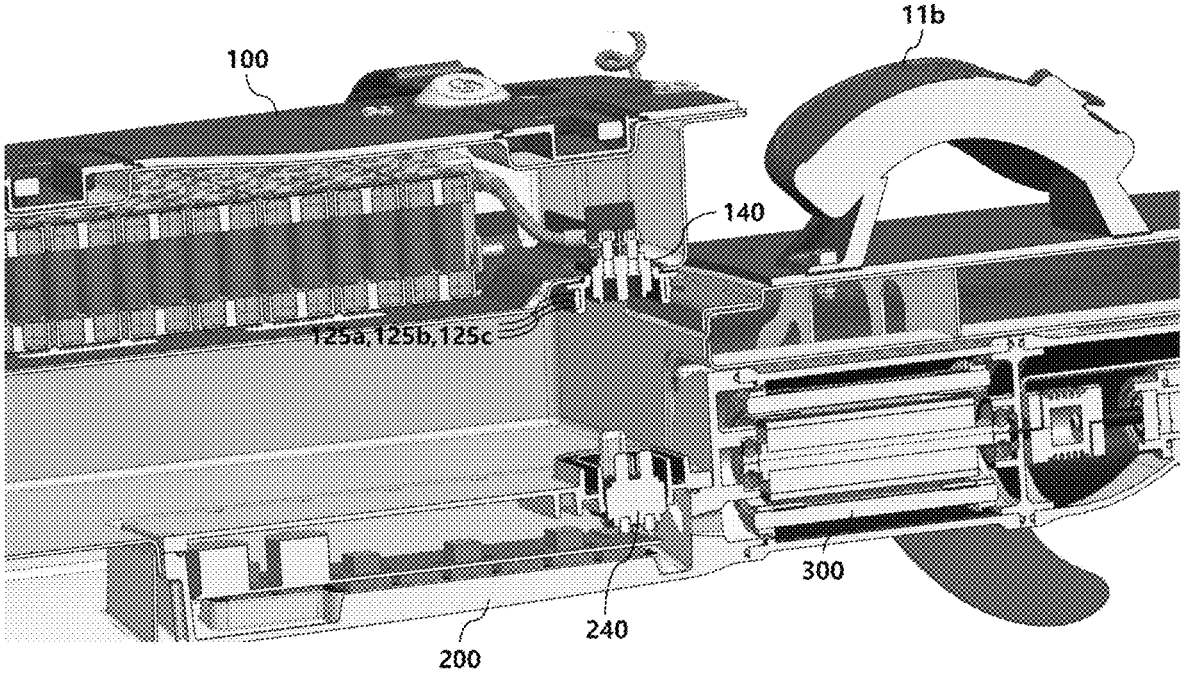
FIGS. 7 and 8 are cross-sectional views illustrating the battery connector coupling member and the control room connector coupling member according to the first embodiment.

The control room connector 240 has first and second guides 241*a* and 241*b* which are spaced apart from each other at both sides and protrude upwardly, and power connecting terminal 242 and a control terminal 243 which are provided in the space between the first and second guides 241*a* and 241*b*. When the control room connector coupling member is electrically connected to the battery connector coupling member, the first and second guides 241*a* and 241*b* are inserted in the first and second guide grooves 141*a* and 141*b* to guide the mutual connection and firmly support the connector at connection. When the control room connector coupling member is electrically connected to the battery connector coupling member, the power connecting terminal 242 is inserted and connected to the power connecting terminal receiving groove 142 to supply the power to the battery pack unit 100 and the control room unit 200. When the control room connector coupling member is electrically connected to the battery connector coupling member, the control terminal 243 is inserted and connected to the control terminal receiving groove 143 to transmit a control signal generated from the control circuit 220 to a battery management system (BMS) of the battery pack unit 100, or transmit a signal generated from the BMS to the control circuit 220. As illustrated in FIGS. 7 and 8, the control room connector coupling member is electrically connected to the battery connector coupling member to supply the power or transmit the data.

As illustrated in FIGS. 2 and 9, the motor unit 300 is directly connected to one end of the room housing 230. Also, a waterjet unit is arranged in series with the motor unit 300. The room housing 230 and the motor unit 300 adhere to the bottom surface of the surfboard and are directly connected to each other, so that the room housing and the motor can be naturally cooled by the water flowing beneath the rear surface of the surfboard. In other words, as illustrated in FIG. 10, the rear surface of the surfboard, on which the room housing 230 and the motor unit 300 are disposed, is submerged under water while the surfboard is riding, and when the surfboard moves forward, the room housing 230 and the motor unit 300 are naturally cooled by the water flowing beneath the submerged rear surface.

The motor unit 300 includes a motor 310 rotated under the control of the control circuit 220, and a motor housing 320 and a rear motor cover 330 which enclose the motor 310 to achieve a waterproof function. The waterjet unit includes a jet tunnel 400 for ejecting sucked water in a rearward direction, an impeller 410 and a shaft 420 which are rotated by the motor 310, a guide vane 500 for guiding the ejected water, and a jet nozzle 600.

The battery pack unit 100 and the control room unit 200 are sequentially disposed at the approximately center region of the housing 10 of the electric surfboard. The control room unit 200 is disposed just beneath the battery pack unit 100. Also, the motor unit 300 and the waterjet unit are directly connected to each other in series at one side of the control room unit 200 in a longitudinal direction (i.e., the motor unit and the waterjet unit are disposed at the right side in FIG. 2). The first foot binding 11*a* is disposed in the front of the battery pack unit 100, and the second foot binding 11*b* is disposed in the rear of the battery pack unit 100, for the purpose of the balance of the surfboard. The second foot binding 11*b* is provided at the upper region of the motor unit 300 and the waterjet unit to balance the surfboard.

Embodiment 2

A surfboard capable of detecting step-out of a user according to the second embodiment of the present invention is configured to automatically stop a motor if the user steps out of the surfboard (for example, the user falls into water while riding on the water, so that the user can easily retrieve the surfboard.

Figure 11:
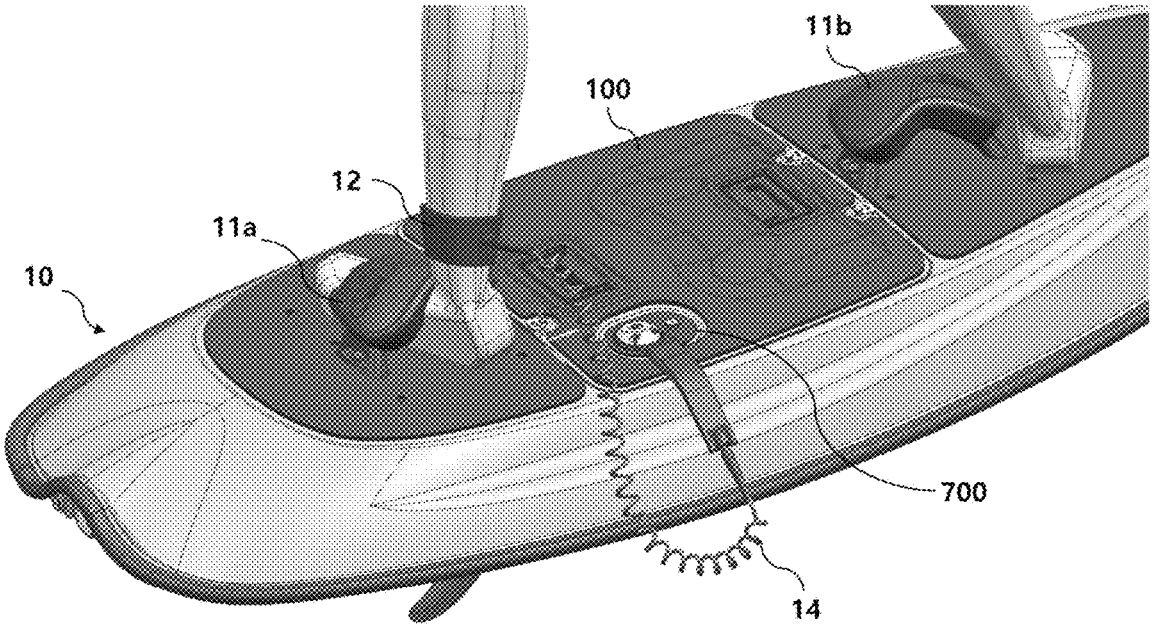
FIG. 11 is a perspective view illustrating an electric surfboard including a step-out detecting member for detecting step-out of a user according to the second embodiment of the present invention.

A step-out detecting unit 700 according to the second embodiment of the present invention is disposed on the top surface of the housing 10, as illustrated in FIG. 11, and preferably, is disposed on the top surface of the battery pack unit 100 to outwardly discharge the heat generated from the battery pack unit and circulate the air. The step-out detecting unit 700 includes an attaching member 710, a holder 720, a metal member 730, and a magnetic switch sensor 740.

Figure 12:
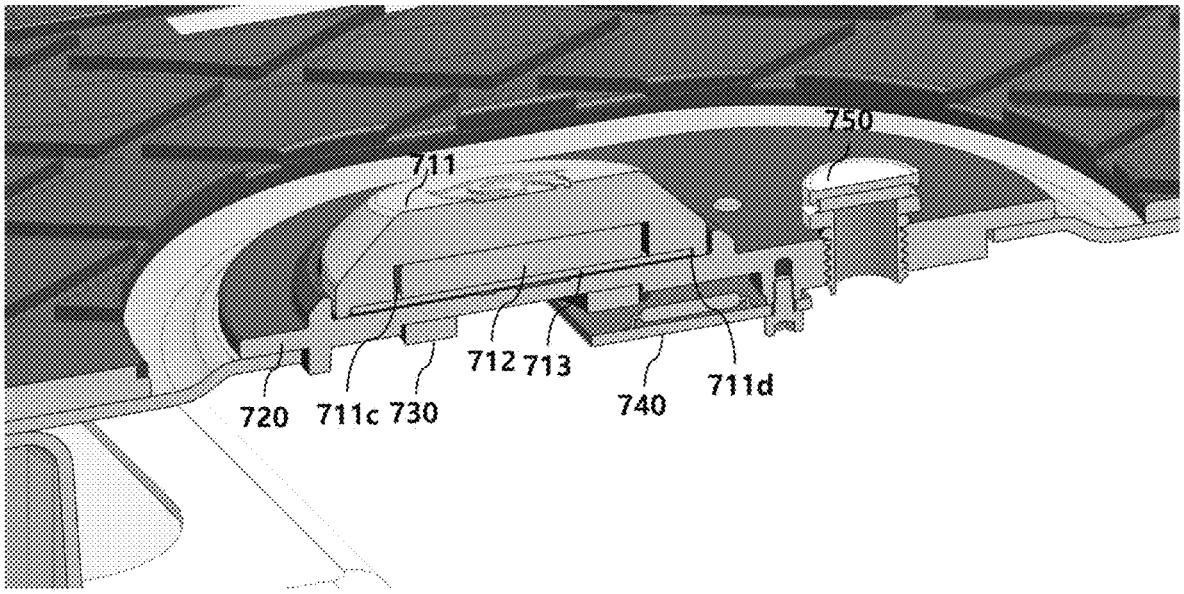
FIG. 12 is a cross-sectional view illustrating the step-out detecting member according to the second embodiment of the present invention.
Figure 13:
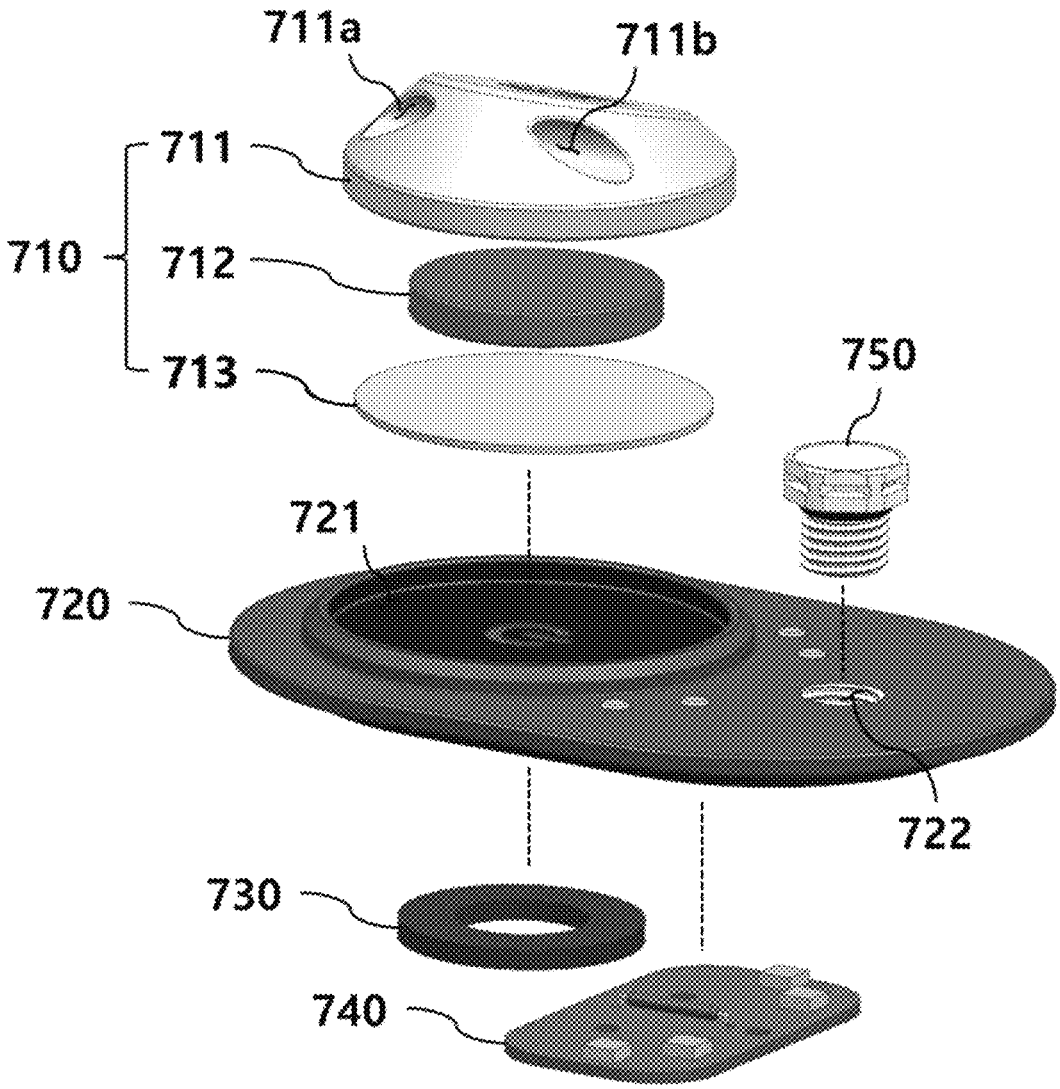
FIGS. 13 and 14 are exploded perspective views illustrating the step-out detecting member according to the second embodiment of the present invention.
Figure 14:
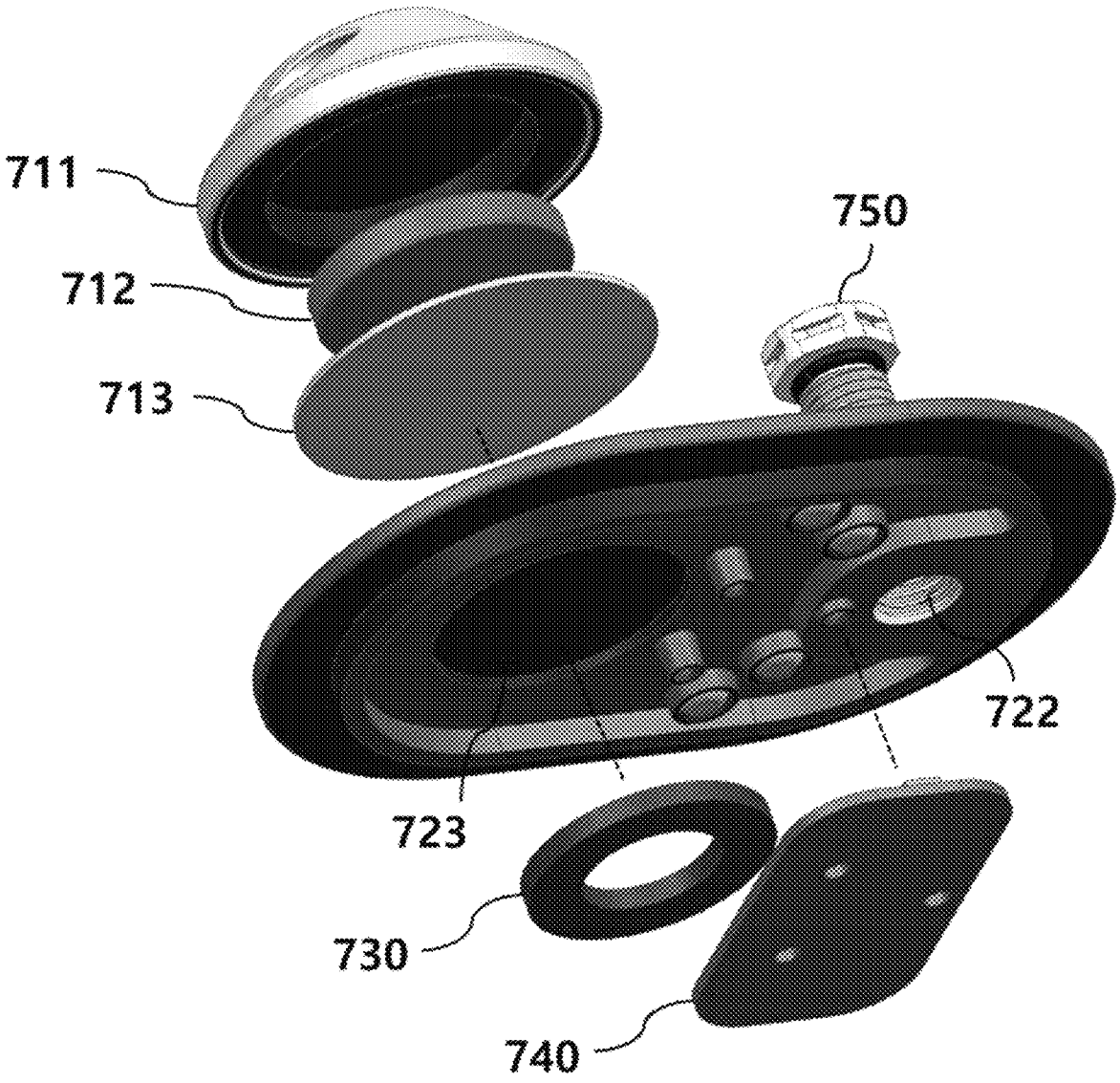

The attaching member 710 has a magnetic cap 711, first and second fixing holes 711*a* and 711*b*, a magnet 712 and a magnetic film 713. Referring to FIGS. 12 to 14, the magnetic cap 711 is provided on an inside thereof with a receiving groove 711*c* for receiving the magnet 712, and a seating groove 711*d*, on which the magnetic film 713 is seated. Accordingly, the magnet 712 is received in the magnetic cap 711, and the magnetic film 713 (magnetic cover) is seated on a lower portion of the magnetic cap 711 to prevent the magnet 712 from being exposed to the outside and to cover the magnet 712 and support the bottom surface thereof. The magnet 712 of the attaching member 710 creates a magnetic field around the magnet, and the metal member 730 is attracted to the holder 720 by the magnetic force. The top surface of the magnetic cap 711 is provided with first and second fixing holes 711*a* and 711*b* which are spaced apart from each other at a certain interval. As illustrated in FIG. 11, the ankle strap 12 putting on the user is tied to the attaching member 710 by a coupling cable 14. In this instance, the coupling cable 14 is fixed to the ankle strap 12 via the first and second fixing holes 711*a* and 711*b*. Accordingly, in the case where the user carelessly falls into water while riding on the water, the attaching member 710 is detached from the holder 720 against the magnetic force since the attaching member 710 is tied to the ankle strap 12. If the attaching member 710 is attracted to the holder 720, the magnetic field is created around the magnet 712, and thus the control unit (not illustrated) detects that the user is on board. If the attaching member 710 is detached from the holder 720, the magnetic field is not created, and thus the control unit detects that the user steps out of the surfboard. In other words, the control unit generates a step-off detection signal, if the magnetic field is created around the step-off detecting unit 700.

The holder 720 is provided on a top surface thereof with a seating groove 721 on which the attaching member 710 is seated, and a threaded portion 722 penetrates the top surface of the holder 720 beside the seating groove 721, to which an air circulating member 722 is fastened. Also, the holder 720 is provided on a bottom surface thereof with a seating groove 723 at a position corresponding to the seating groove 721, on which the metal member 730 is seated. If the metal member 730 is seated on the seating groove 723 formed on the bottom surface of the holder and the attaching member 710 is seated on the seating groove 721 formed on the top surface of the holder, the attaching member 710 is secured to the holder 720 by the magnetic force. The holder 720 is provided on the top surface of the battery pack unit 100.

The metal member 730 is made of a metal material, i.e., steel, to be responsible for the magnetic force of the magnet 712 of the attaching member, and is seated on the seating groove 723 of the holder. The magnet 712 and the metal member 730 are formed in the cross-sectional shape of a circle or ellipse. The magnetic switch sensor 740 is positioned near the metal member 730 to detect the magnetic field. Specifically, the magnetic switch sensor 740 has a sensor for detecting the magnetic field to generate a signal, and a control unit for receiving the signal from the sensor to generate a step-out detecting signal. The magnetic switch sensor 740 is preferably positioned below the metal member 730 to easily detect the magnetic field. If the magnetic switch sensor 740 is disposed at a wrong position, it is possible to generate an error signal indicating the step-out, even in the case where the attaching member 710 is attached to the holder 720. The magnetic switch sensor 740 is preferably disposed at the lower region of the metal member in such a way that a disposed range of the magnetic switch sensor 740 is partially overlapped with that of the metal member 730. The control unit generates the step-out detecting signal according to the signal from the sensor for detecting the attachment/detachment of the attaching member 710, and generates a drive stop signal for stopping the operation of the motor according to the step-out detecting signal to send it to the control room unit 200. The control room unit 200 stops the operation of the motor according to the drive stop signal, thereby stopping the surfboard when the user steps out of the surfboard.

Figure 15:
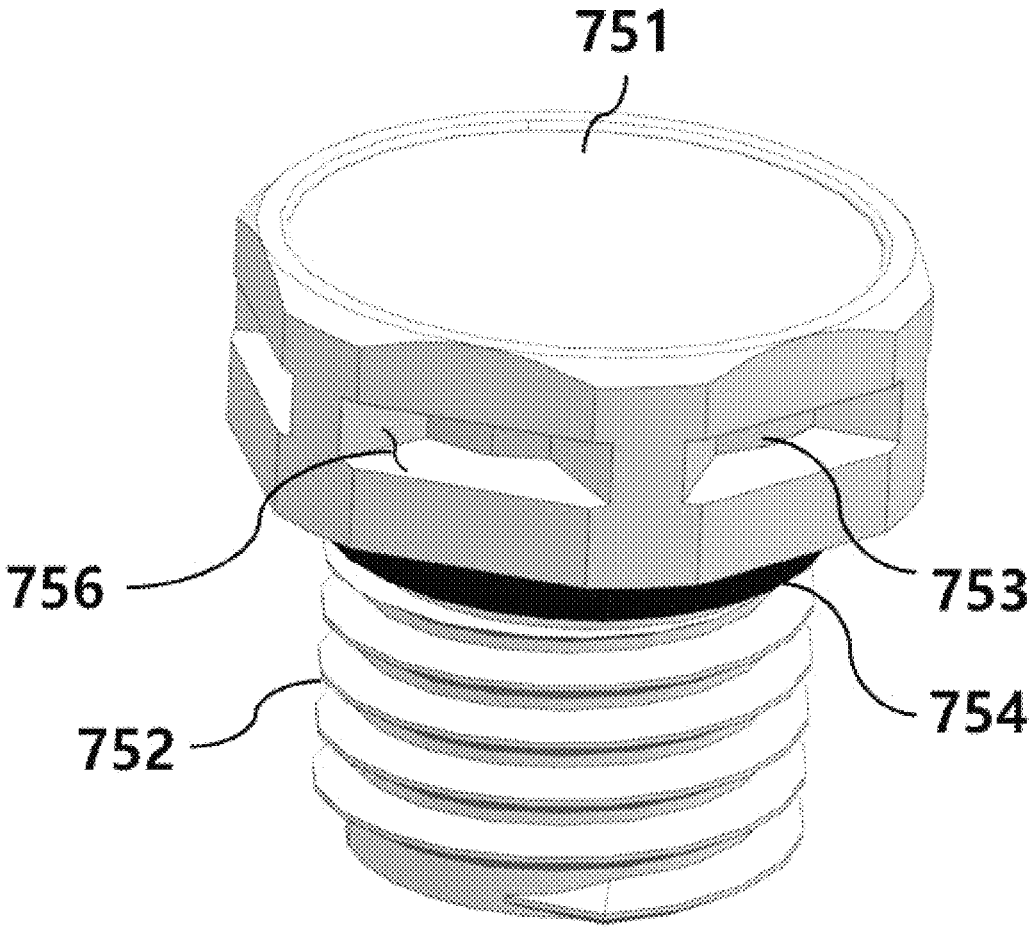
FIG. 15 is a perspective view illustrating an air circulating member according to the second embodiment of the present invention.
Figure 16:
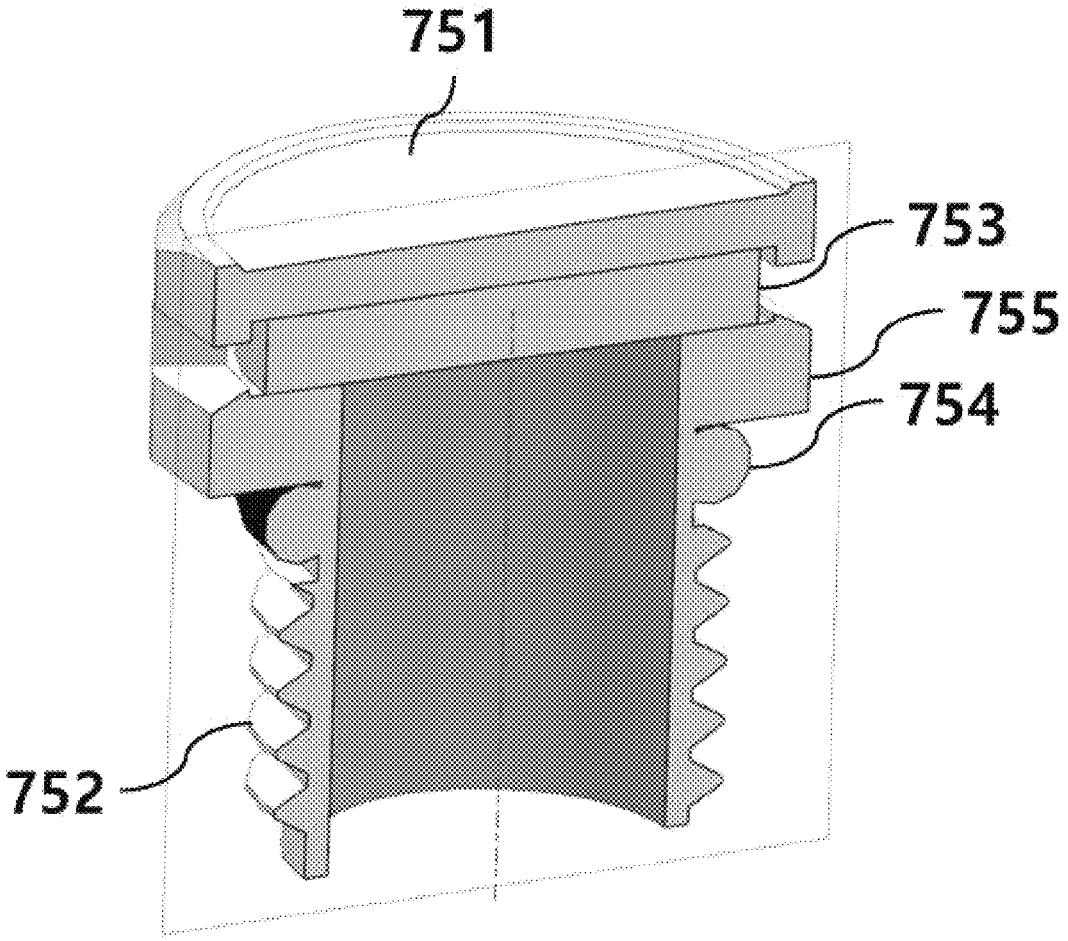
FIG. 16 is a cross-sectional view illustrating the air circulating member according to the second embodiment of the present invention.

An air circulating member 750 is threadedly fastened to the threaded groove 722 of the holder. As illustrated in FIGS. 15 and 16, the air circulating member 750 has a head portion 751 and a shank portion 752 extending from the head portion. The shank portion 752 is provided with a threaded portion on an outer peripheral surface thereof, and is threaded fastened to the threaded groove 722. When the shank portion 752 is threadedly fastened to the holder 720, the head portion 751 protrudes outwardly from the holder to circulate the air. The shank portion 752 is provided with the threaded portion on the outer peripheral surface, and has a hollow portion in the inside. Since the shank portion has the hollow portion, the shank portion 752 communicates with the inside of the battery pack unit 100 even through it is threadedly fastened to the holder 720, so that the heat generated from the battery pack unit 100 can move in the shank portion 752. The head portion 751 has a diameter larger than that of the shank portion 752. The head portion 751 has a fabric portion 753 therein which is smaller than an outer diameter of the head portion 751 but is larger than an inner diameter of the shank portion 752. The fabric portion 753 communicates with the inside of the shank portion 752, so that the heat generated from the battery pack unit 100 is discharged outwardly through the inside of the shank portion 752 and the fabric portion 753, and the air circulation occurs. In order to allow the fabric portion 753 inserted in the head portion 751 to outwardly discharge the heat generated from the battery cells, the head portion 751 is preferably provided with discharge grooves 756 along an outer circumference of a flange at regular intervals. For example, the fabric portion 753 is a membrane of fluoropolymer with fine voids which can provide an air circulation function and a waterproof function (waterproof, wind break and moisture permeability). A waterproof ring 754 is fitted in a bottom surface 755 of the head portion 751 in a circumferential direction to prevent the water from flowing into the inside of the battery pack unit 100 via the shank portion 752.

The above-described step-out detecting unit 700 is adhered to the holder by the magnetic field, and detects the step-out of the user by sensing the magnetic field. Alternatively, the step-out detecting unit 700 may be a load cell attached to the housing 10 of the surfboard, so that it is determined whether or not the user is on board, on the basis of a signal outputted from the load cell. Specifically, the load cell is disposed below the top surface of the housing 10 having the foot bindings 11*a* and 11*b*, and is electrically connected to the control unit, so that the control unit can detect the step-out of the user according to the signal outputted from the load cell. If it is determined that the user steps out of the surfboard, the control unit stops the operation of the motor. The load cell may be disposed at any one or both of the foot binders.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An electric surfboard comprising:

a surfboard housing;

foot bindings which are disposed on a top surface of the surfboard housing at front and rear portions thereof, respectively;

a battery pack unit which is detachably mounted in a space between the foot bindings from the top surface of the surfboard housing to a bottom surface;

a control room unit which is fixed to the bottom surface of the surfboard housing in a space between a bottom surface of the battery pack unit and the bottom surface of the surfboard housing so as to be naturally cooled by water flowing below a rear surface of the surfboard when a motor operates, the control room unit controlling operation of the motor;

a motor unit which is driven under a control of the control room unit, is fixed to one side of the control room unit, and is disposed on the bottom surface of the surfboard housing so as to be naturally cooled by the water flowing below the rear surface of the surfboard when the motor operates; and a waterjet unit which is coupled to the motor unit in series to generate a driving force of the surfboard according to operation of the motor unit, in which the battery pack unit is disposed at a center region of the surfboard, which corresponds to a center of gravity, in view of a series arrangement of the motor unit and the waterjet unit, wherein a pair of connectors are respectively disposed on the bottom surface of the battery pack unit and a top surface of the control room unit to be connected to the battery pack unit and the control room unit, thereby supplying a power from the battery pack unit to the control room unit, wherein the top surface of the control room unit is provided with a first partition protruding upwardly from one end thereof, a second partition protruding upwardly and disposed inside the first partition, a waterproof groove formed in a space between the first and second partitions, and a connector receiving groove formed inside the second partition to receive the control room connector, a bottom surface of the battery pack unit is provided with a seating groove, a base formed in the seating groove, a protrusion protruding from the base and formed in a shape corresponding to the first and second partitions, and a waterproof sealing fitted onto the protrusion in a circumferential direction and inserted in the waterproof groove together with the protrusion, the control room connector has first and second guides which are spaced apart from each other at a certain interval and protrude upwardly, power connecting terminal formed between the first and second guides, and a control terminal which is formed between the first and second guides to transmit a control signal outputted from the control room unit, and the battery connector is provided with first and second guide grooves for receiving the first and second guides, a power connecting terminal receiving groove for receiving the power connecting terminal and to be electrically connected to the power connecting terminal, and a control terminal receiving groove for receiving the control connecting terminal and to be electrically connected to the control connecting terminal.

* * * * *